US005407013A

United States Patent [19]

Scott

[11] Patent Number: 5,407,013

[45] Date of Patent: * Apr. 18, 1995

[54] GRAVEL SCARIFYING AND LEVELLING DEVICE

[76] Inventor: Norman L. Scott, #6 Gallerno Street, Port Lambton, Ontario N0P 2B0, Canada

[ * ] Notice: The portion of the term of this patent subsequent to Nov. 30, 2010 has been disclaimed.

[21] Appl. No.: 34,968

[22] Filed: Mar. 23, 1993

Related U.S. Application Data

[63] Continuation of Ser. No. 714,809, Jun. 13, 1991, Pat. No. 5,265,975.

[51] Int. Cl.[6] ..... A01B 19/02

[52] U.S. Cl. ..... 172/762; 172/382; 172/713

[58] Field of Search ..... 172/382, 614, 763, 713, 172/762, 741

[56] References Cited

U.S. PATENT DOCUMENTS

| | | | |
|---|---|---|---|
| 776,394 | 11/1904 | Haworth | 172/763 |
| 2,374,424 | 4/1945 | Davis | 172/382 |
| 3,643,747 | 2/1972 | Taylor et al. | 172/713 |
| 3,705,630 | 12/1972 | Vissers | 172/713 |
| 4,924,946 | 5/1990 | Dietrich, Sr. | 172/382 |
| 5,248,000 | 9/1993 | Goto et al. | 172/762 |

*Primary Examiner*—Randolph A. Reese
*Assistant Examiner*—Spencer Warnick
*Attorney, Agent, or Firm*—James W. Kerr

[57] ABSTRACT

A scarifier/grader apparatus comprises, in combination, a tractor connected through a 3-point hitch to a scarifier/grader attachment wherein:

the tractor is adapted to be operably connected through a three point hitch to a scarifier/grader attachment comprising a scarifier including hydraulics for raising and lowering a plurality of scarifying teeth borne thereon;

a grading blade having a mold board and a cutting edge;

a second frame interconnecting the scarifier frame and the blade in mutually spaced apart relation with the scarifier in operably leading relation and the blade in operably trailing relation, wherein the scarifier includes height-adjusting hydraulics for selectively raising and lowering the plurality of scarifying teeth borne thereon relative to the cutting edge.

4 Claims, 4 Drawing Sheets

GRAVEL SCARIFYING AND LEVELLING DEVICE

This application is a continuation of the applicant's earlier filed U.S. patent application Ser. No. 07/714,809, filed Jun. 13, 1991, now U.S. Pat. No. 5,265,975.

FIELD OF THE INVENTION

The present invention relates to devices for scarifying and levelling gravel roadways, parking lots, and the like.

BACKGROUND OF THE INVENTION

Gravel roads, gravel shoulders, gravel parking lots, all exemplify the use of gravel in economically facilitating both vehicular and pedestrian traffic over defined areas and routes. For various reasons, the use of gravel in these applications can be very much more attractive than the alternatives afforded by asphalt and concrete paving.

The use of gravel, however, is not without its own complications. Uneven compaction over the travelled surface can lead to the formation of wheel ruts, while turning, accelerating or decelerating traffic can lead to local phenomenon such as potholes and corrugations; and, the aggregate material will itself tend to undergo a sorting, by particle size, attributable to differential compaction effects, the results of all of which are less than attractive. In some cases, these effects represent safety hazards.

One solution to the degradation of such gravel emplacements has been to simply add additional gravel over the surface, as needed. Interestingly, there is only a limited consolidation between the added material and the underlying surface, which tends to leave the upper, relatively unconsolidated material in an easily disturbed layer from which aggregate material tends to be rapidly displaced. Moreover, commercial sources of aggregate depend of naturally occurring gravel deposits, and like most natural resources, their numbers are becoming depleted. Although the existence of many more marginal deposits stave off any likelihood of critical shortages of supply, the costs of harvesting a more marginal deposit is inherently higher, and this is reflected in higher gravel costs.

As a consequence, the historical practice most often adopted to remediate gravel roads, parking lots and the like, have entailed the use of large, powerful road graders, equipped with scarifiers. A grader is, by definition, a machine with a centrally located blade that can be angled to either side. Typically, graders have a reinforced tubular or box-beam "Y" frame supporting the engine at the rear of the vehicle, between the arms of the "Y". Drive wheels, usually arranged in tandem, are positioned below the engine and transmission, while steering wheels are arranged on an axel system at the point of the "Y" frame. The major attachments for the grader are secured in downwardly hung relation from the overhead portions of the frame, and are pulled by a drawbar reaching back from the front of the frame. These attachments include the blade and the scarifier.

More specifically, the blade is arranged on a toothed ring gear called the "circle", on which the attachments can be rotated. An arm-type attachment between the "circle" and the frame allow the circle to be controllably lifted, lowered, offset to either side, or even to be placed into a vertical configuration. The scarifier is typically position in front of the blade, and is carried on a pair of arms that reach back from the front end of the graders frame. The scarifier can be raised and lowered to regulate the depth of penetration, relative to the bottom of the graders tires. The number of teeth used on the scarifier is dependent on the hardness of the surface being worked.

Attempts at smaller scale scarifiers have been unsuccessful from a performance point of view, and have not enjoyed commercial acceptance. One such attempt took the form of a towed "box scarifier". This consisted of a scarifier and a plough blade arranged at opposed ends of a frame which a had a box shaped plan. The device was dragged along by a vehicle with the intention that the scarifier would turn up the underlying aggregate and the plough blade would evenly redistribute it. Unfortunately the device was neither heavy enough to scarify properly, nor did it afford the control necessary to evenly redistribute even such material as was dislodged by the scarifier teeth. The problem is similar to that encountered with very early attempts to use towed road construction rippers, the use of which has now apparently been abandoned. Towed rippers too, proved to be unsatisfactory do to poor penetration. If sufficient weight was added to the towed ripper to insure effective penetration, the ripper became too heavy for any but the largest of commercial tractor vehicles. These towed rippers were also rather unwieldy, and hard to manoeuvre. Lastly, such rippers were not grading devices, and are simply a battery of teeth mounted on a wheeled vehicle.

Towed graders were also known. These were produced in an attempt to deal with a number of grader-related problems, but are now considered outmoded. Their use required two skilled operators, which was an offset to the presumed advantage of reduced capital and maintenance costs. They were in any case, found to be hard to manoeuvre even relative to motorized graders, and were never known to be used in scarifying operations. There is the further problem that the tow vehicle tends to compact the material that the towed grader was intended levelingly redistribute.

Accordingly, the only known commercially viable practice continues to rely on the use of motorized graders. Graders provide sufficient weight and power to force the scarifier teeth into the ground and drag it along, together with the control necessary to position a grader blade for proper redistribution of the dislodged materials.

The problems that are and have always been immediately apparent in connection with the use of graders for this purpose continue to be a problem, however. These include a requirement for a highly skilled operator. Moreover, graders are not highly manoeuvrable, a problem which is a function of the very size and weight heretofore thought necessary to achieve scarifying/-grading operations. Moreover, the economics of grader operation are very sensitive. For example, according to "HEAVY CONSTRUCTION—Equipment and Methods"—by Stuart Wood Jr., points out that straight line grading patterns that cover less than 1000 linear feet, are economically inefficient because of the operating/time costs associated with turning the grader around. Even were the economics otherwise, the large size of graders make them difficult or even impossible to manoeuvre in the manner necessary to service the close quarters that characterize many gravel emplacements. The travelling costs of grader equipment are very high, and some jobs are often not done at all particularly if they are in geographically isolated areas.

SUMMARY OF THE INVENTION

In accordance with one aspect of the present invention, there is provided a scarifier which comprises a plurality of supported, downwardly depending, axially secured scarifying teeth having substantial lateral free play at respective scarifying tip ends thereof. It has been found, and this finding forms one basis for the present invention, that the lateral free play of the scarifying teeth tips improves the scarifying ability of the device. Embodiments of the present invention have been found to satisfactorily remediate gravel traffic courses when, in accordance with the present invention, scarifiers are use in combination with light,low powered utility tractors, connected through a three point hitch. The thusly equipped vehicle is highly manoeuvrable, easy to operate, requires only a relatively moderate capital outlay, and unlike a grader, which is a relatively special purpose vehicle, the tractor can be readily employed to other ends.

The scarifier of the present invention can include a scarifying-tooth supporting frame adapted to be connected in loose fitting relation to a driving means, to thereby operatively impart lateral play at respective scarifying tip ends. In an exemplary embodiment, the supporting frame has a bracket means adapted to engage respective shank portions of the downwardly depending plurality of scarifying teeth. The bracket thereby holds these teeth in axially secured relation, but with sufficient degrees of lateral freedom to provide lateral play to spaced apart scarifying points of respective ones of the teeth.

In another general aspect, the scarifier has a scarifying-tooth supporting frame that is adapted to be connected in loose fitting relation to a driving means to thereby operatively impart a first component of lateral play at respective scarifying tip ends. Such a frame preferably also includes bracket means adapted to engage respective shank portions of the scarifying teeth in axially secured relation with sufficient degrees of lateral freedom to provide a second lateral play to spaced apart scarifying points of respective ones of the teeth.

Teeth useful in the practice of the present invention include those which comprise hardened tips arranged on unhardened shanks. In any case, teeth are preferably arranged in an array of pairs comprising corresponding ones of leading and trailing teeth. In an especially preferred form the leading teeth extend to a first operating depth, and the second teeth extend to a second, greater operating depth. While this can be accomplished by utilizing teeth of different lengths, it is preferred that this result be controllably realized through pitch orientation control of the scarifier as a whole, whereby the angle of attack positions the leading and trailing teeth at different respective heights relative to the surface being scarified.

In one form, the teeth comprise a scarifying tip arranged in axially spaced relation along the shank from axial interference means thereon, the interference means being adapted to operate in axially interfering relation against a portion of the frame. In this arrangement, a preferred bracket can be used, which comprises a pair of plates including a first plate adapted to receive shank portions of ones of the teeth through corresponding ones of openings extending through the first plate. These openings receive the teeth in surroundingly loose fitting relation about the shank, with the tip extending below a lower side of the plate and the axial interference means extending above an opposite upper side of the first plate. A second plate on this bracket is adapted to be secured in fixed, spaced apart relation above the upper surface of the first plate. The axial interference means is thereby secured between the first and second plates.

In especially preferred forms of the present invention, the scarifier is adapted to controllably position the teeth at selected elevations relative to a work surface. Also, it is preferred that the scarifier include means adapted to position the teeth to follow a work surface contour, in constant weight transferring relation with the surface. This helps to maintain a relatively consistent load on the driving vehicle, and makes it generally easier to maintain a constant speed over the work surface. Conventional draft control systems can be used for this purpose. Also, means for controllable positioning of the frame in selected attitudes relative to a work surface can facilitate the scarifying operation. This includes the ability to controllably position the attack angle attitude of the frame, and to controllably position the pitch attitude of the frame.

In accordance with another aspect of the present invention, there is provided a scarifier/grading device comprising in combination:

- a scarifier (at least one, although more than one may be used in tandem if desired), including a plurality of scarifying teeth borne thereon;
- a grading blade having a mold board and a cutting edge;
- a second frame interconnecting the scarifier frame and the blade in mutually spaced apart relation with the scarifier in operably leading relation and the blade in operably trailing relation, wherein the scarifier includes height-adjusting means for selectively raising and lowering a plurality of scarifying teeth borne thereon relative to the cutting edge. Preferably the height-adjusting means comprises an at least one hydraulic cylinder.

Consistent with the interest in enabling the scarifying operation to be carried out utilizing light weight, relatively low powered tractors, it is preferred that the blade has a concave shaped, leading mold board surface. This surface shape increases the load carrying capacity of the blade, by rolling the material captured by the blade is lifted, and then rolled forwardly. This keeps an inventory of material before the blade, and available for levelling out minor irregularities that the blade passes over. It is also preferred that the second frame be open-sided to thereby permit the egress of excess substrate material collected on the blade. This allows the blade to continue to operate efficiently in facilitating the levelling operation, and without overloading the vehicle through the accumulation of excess mass in front of the blade.

In accordance with the present invention, there may be included a plurality of grading blades, which can facilitate special grading functions. For example, the grading of a roadway with a crown, the leading blade is preferably adapted to direct the scarified material outwardly towards the centre of the roadway, to a point where it is deposited in the path of the foremost end of a sidewardly offset, trailing blade, which is adapted to capture and partially redistribute the material back towards the shoulder of the roadway, to achieve an appropriate crown profile. This is accomplished by having the two blades arranged at mutually offset angles to one another. The device as a whole is made more flexible in embodiments in which the offset angles are independently controllably selectable.

Note that the typical application of the last above-mentioned aspect of the present, invention entails operating the device with the scarifier in the lead of the plough. The device may be employed bidirectionally, however, if desired or necessary, and this can be accomplished with particular facility in embodiments wherein the plough is adapted to facilitate bidirectional ploughing, and the combination allows for selective relative positioning of the scarifier and the blade.

In especially preferred embodiments of this aspect of the present invention, there is provided means adapted to selectively position the device at a desired elevation relative to the work surface. Moreover, means for selectively controlling the attitude of the device relative to a work surface is desirable. Attitude control means adapted to selectively pitch of the device is one example of this facility. Angle of attack is another attitude control means which is highly preferred.

In an especially preferred form, the device in accordance with the practice of the present invention takes the form of a removable attachment device. In an especially preferred form such an attachment device is adapted to be received in attached relation on a three point hitch. The three point hitch is then operable to provide elevation control over the attachment. In an especially preferred form the three point hitch has a centre link which comprises a hydraulic cylinder operable to selectively control the attack angle. Similarly, a preferred three point hitch is one in which at least one of the lift links comprises an hydraulic cylinder operable to selectively control the pitch angle of the device.

In this latter connection therefore, the present invention further extends to a three point hitch in which attachment pitch control means comprises a rock shaft hingedly connected to lift arms, interconnected through lift links to draught links in "third" class lever relation; wherein one of the lift links is an hydraulic cylinder. In a preferred form a telescoping shaft extends in interconnecting relation between the draught arms, and includes a sleeve for connecting the lift link comprising an hydraulic cylinder operable to be controllably lengthened and shortened to change the pitch of an attachment. As already mentioned hereinabove, the centre link preferably comprises an hydraulic cylinder.

In an especially preferred aspect of the present invention there is provided a scarifier/grader apparatus comprising, in combination, a tractor connected through a 3-point hitch to a scarifier/grader attachment wherein:

the tractor is adapted to be operably connected through a three point hitch to a scarifier/grader attachment comprising a scarifier including means for raising and lowering a plurality of scarifying teeth borne thereon;

a grading blade having a mold board and a cutting edge;

a second frame interconnecting the scarifier frame and the blade in mutually spaced apart relation with the scarifier in operably leading relation and the blade in operably trailing relation, wherein the scarifier includes height-adjusting means for selectively raising and lowering a plurality of scarifying teeth borne thereon relative to the cutting edge.

In addition to scarifying gravel traffic areas, the present invention is useful in, inter alia, landscaping applications. Although applicable in other uses, a feature in accordance with one aspect of the present device that is useful in landscaping applications, is a bidirectional plough blade comprising a structural beam oriented in a horizontal plane, and forming a mold board, with a cutting edge arranged on an edge-supporting portion of the blade that is attached to, and extends in a vertical plane beyond either side of the bottom of that beam.

As will also be apparent to the person skilled in the relevant arts, the present device can be employed in conjunction with laser guided hydraulic control systems.

DETAILED DESCRIPTION OF A PREFERRED EMBODIMENT

Introduction to the Drawings

Over the course of the detailed description which follows hereinbelow, reference will be made to the appended drawings, in which.

Figure 1:
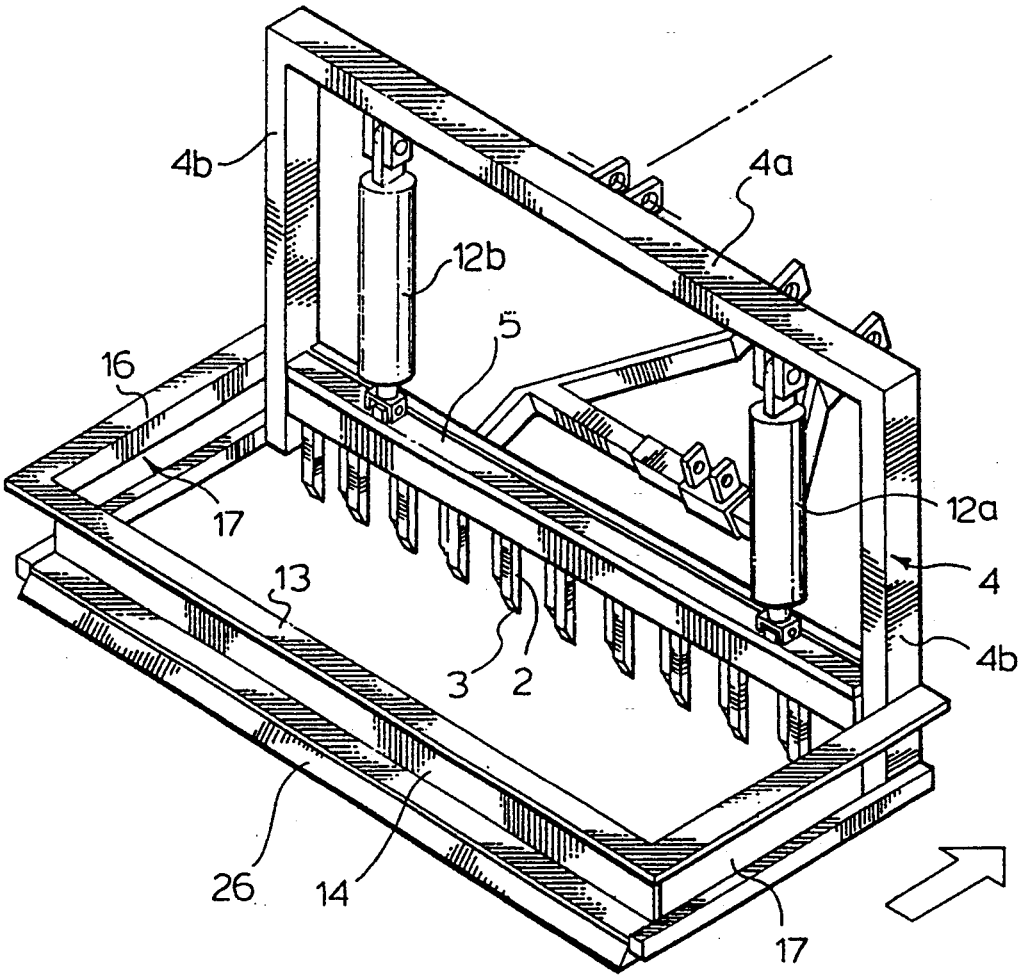
FIG. 1 is a perspective view of a preferred embodiment of the present invention, showing a combination scarifier/levelling blade attachment.
Figure 3:
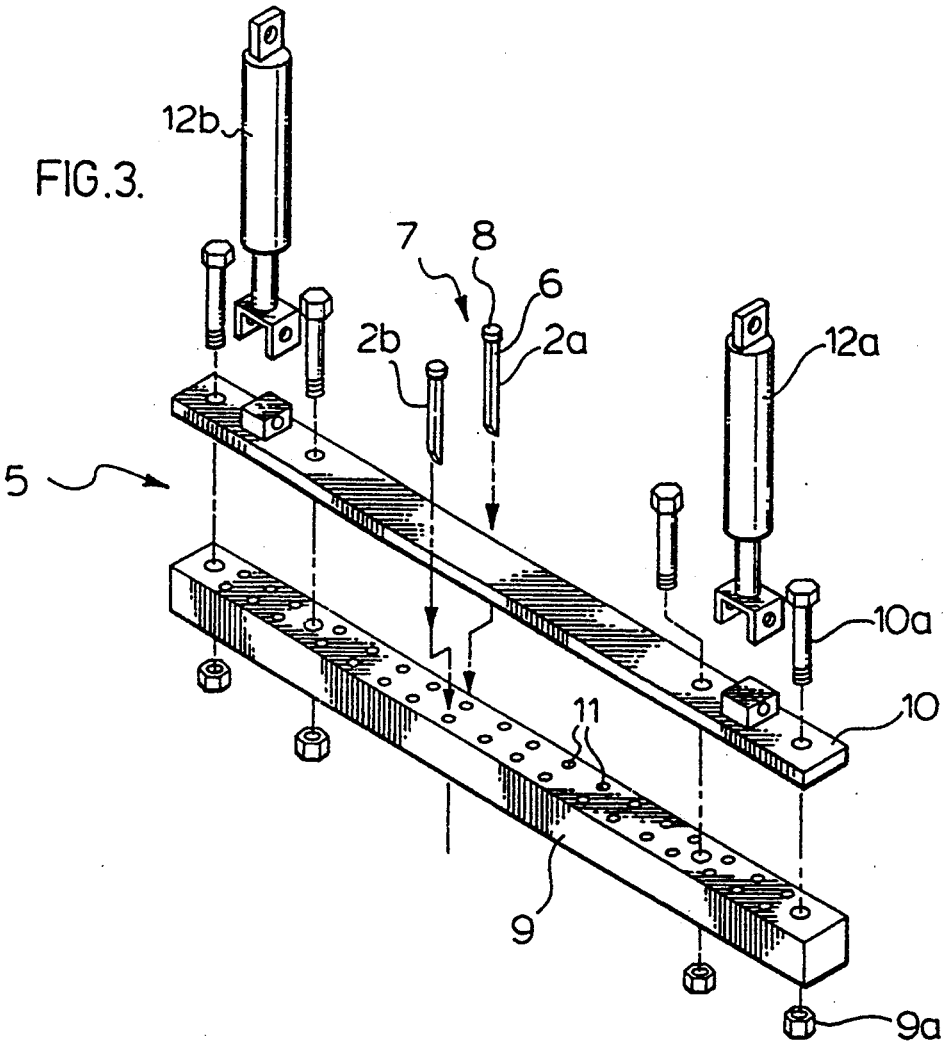
FIG. 3 is an exploded perspective view of a bracket assembly for a scarifier according to the present invention.
Figure 4:
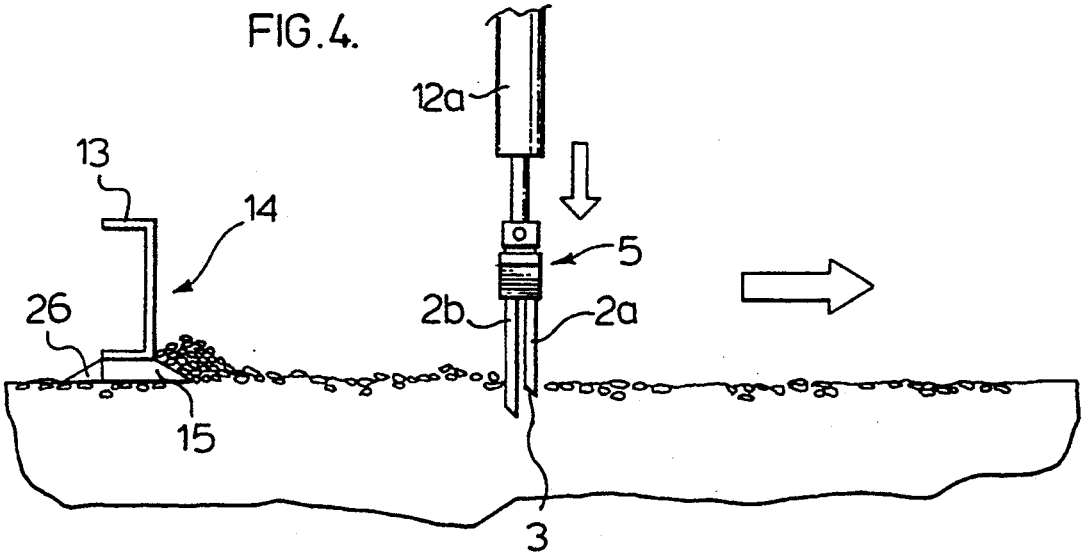
Figure 3A:
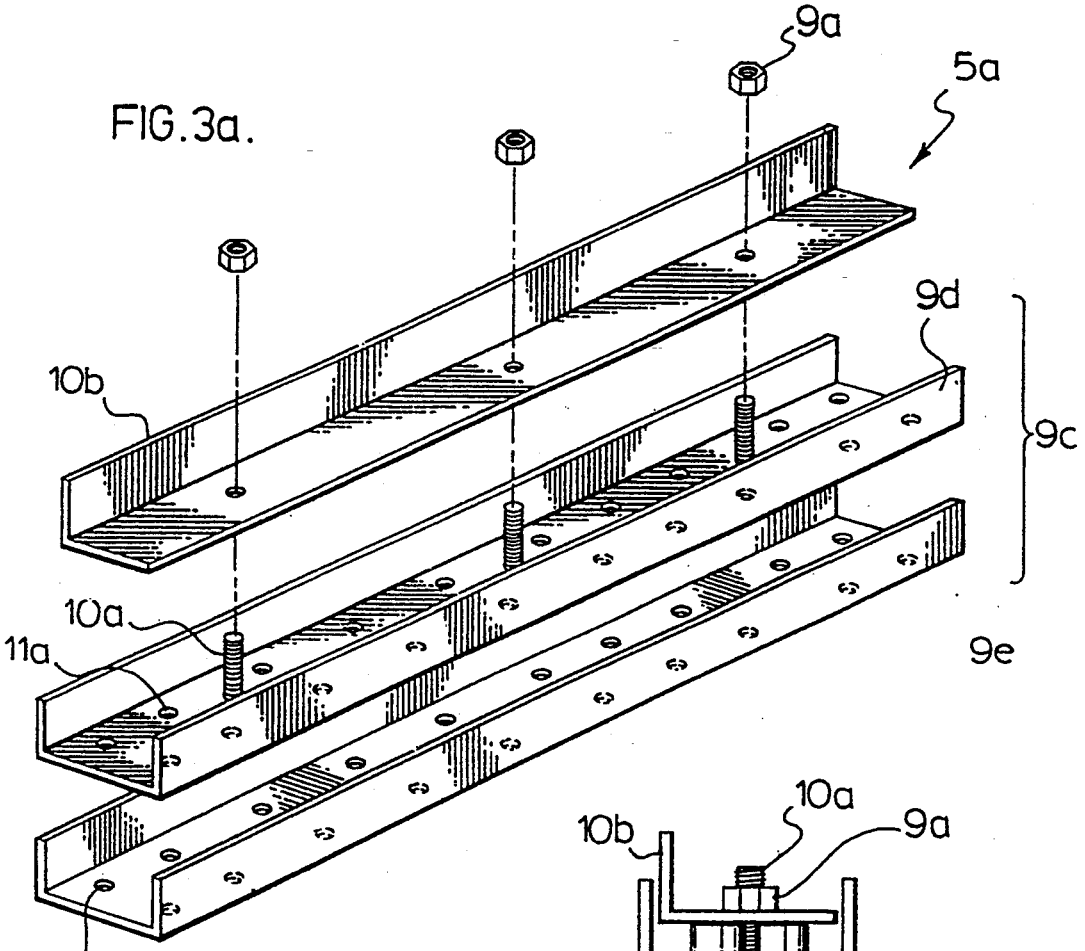
Figure 3B:
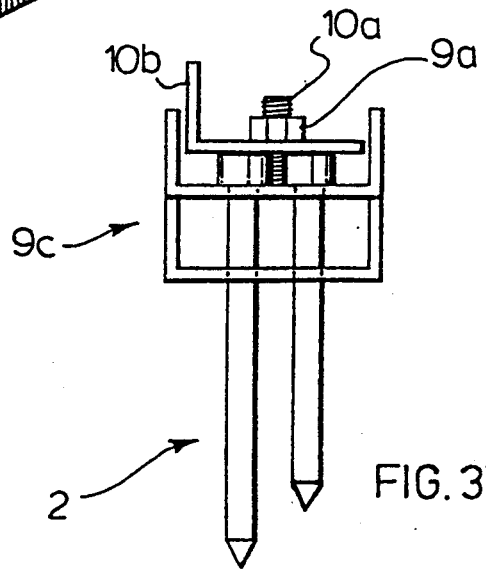
Figure 5:
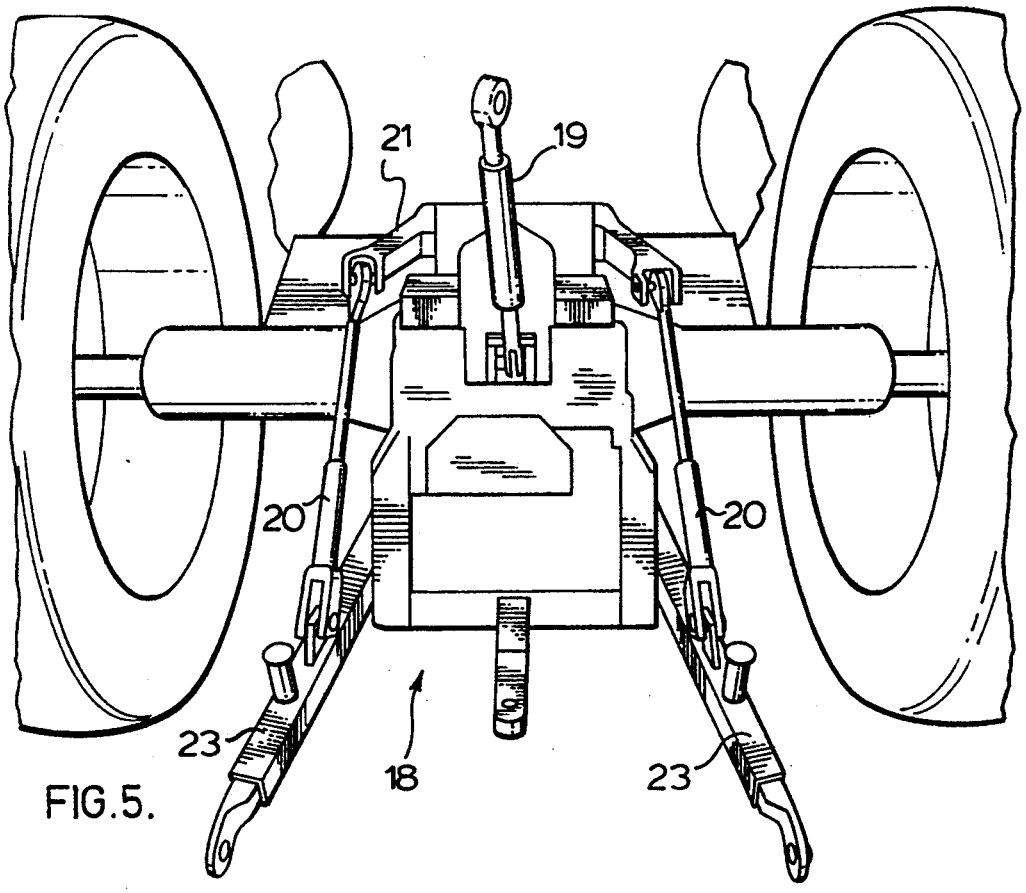
Figure 5A:
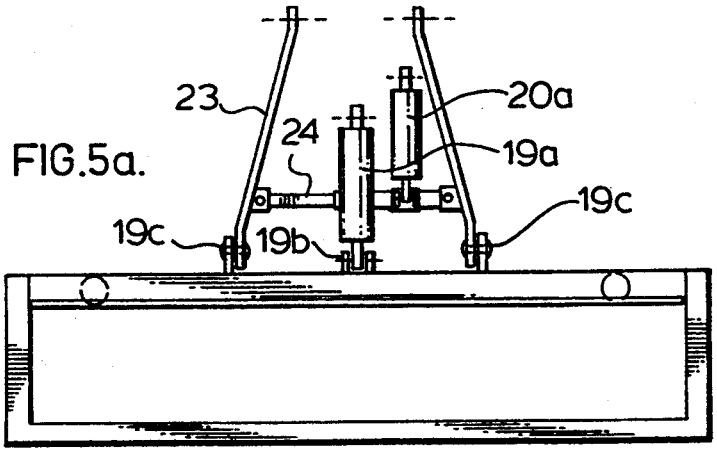
Figure 5B:
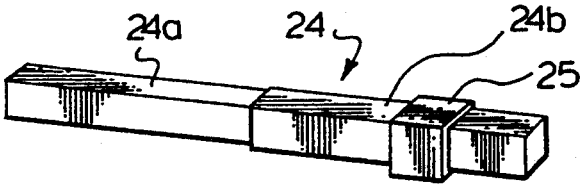

FIGS. 3*a* and 3*b* are exploded perspective and cross-sectional end views, respectively, of an alternate bracket according to the present invention;

FIG. 4 is an elevated sectional, side view illustrating the combination of the scarifier and blade depicted in FIG. 1;

FIG. 5 is a rear perspective view of a conventional three point/hitch arranged on the back of a utility tractor;

FIG. 5*a* is a top plan view of the combination scarifier/blade attachment shown in FIG. 1, in combination with attached portions of a modified three point hitch according to the present invention; and, FIG. 5*b* is a view of the telescopically positionable interconnecting shaft that extends between the two draft links of an especially preferred modified three point hitch in accordance with one aspect of the present invention.

Referring now to FIG. 1 of the drawings, there is depicted a scarifier 1 comprising a plurality of teeth 2, including respective tips 3, supported by a supporting frame 4 which includes a bracket means 5. The scarifier 1 includes height adjusting means in the form of a pair of spaced apart hydraulic cylinders 12*a* and 12*b* which are operably connected between an overhanging horizontally extending member 4*a*, and bracket means 5 which is slidably arranged in vertically extending channels formed in vertically extending frame members 4*b*. The illustrated embodiment includes, in combination with scarifier 1, a blade 13 having a mold board 14 and a cutting blade 15. These are fixedly secured to scarifier 1 through a second frame 16 that is rigidly co-joined to supporting frame 4. Openings 17 in the sides of second frame 16 provide for the egress of excess scarified materials from in front of blade 13, so as to make the load manageable. Blade 13 also includes a trailing shoe 26 which can be usefully employed in free floating the blade during levelling operations, as will be apparent to persons skilled in the art in light of the present invention. In this frame arrangement, the scarifier 1 and the blade 13 are co-operable in a mutually dependent relation, that is distinguishable from the mutually independent operation of scarifiers and grading blades used on graders. One advantage of the present invention in this respect is the greater ease with which the scarifier and plough can be cooperatively oriented, particularly when the device is employed by a relatively unskilled operator. In addition, the present device can be readily connected in tandem with a compaction device, such as a roller, through a tow bar or tongue affixed to the rear of the device, to accomplish the complete surface conditioning task in a single pass, when conditions permit.

Figure 2:
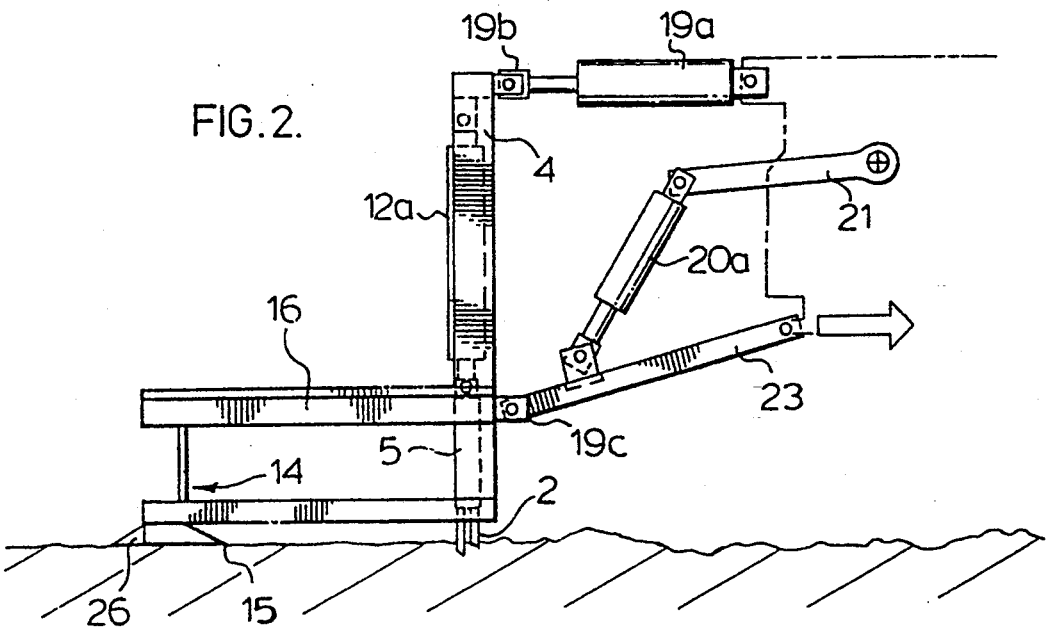
FIG. 2 is an elevated side view of the attachment illustrated in FIG. 1, shown in operative combination with a modified three point hitch, also according to the present invention.

FIG. 2 of the drawings depicts the device according to FIG. 1, in an elevated cross sectional view which emphasises the three point hitch connections preferred herein. More specifically, there is illustrated a three point hitch and scarifier/blade attachment in interconnected relation. In accordance with this preferred practice, the vertical frame member 4*a* is interconnected through a pivot attachment point 19*b*, to a centre link hydraulic cylinder 19*a*. More particularly, it is preferred that connection point 19*b* include a bracket extending from frame member 4*a*, that includes oversize holes adapted to receive an undersized connection pin. In the exemplary embodiment a one and one quarter inch diameter hole accommodates a one inch diameter pin. The pin is thereby adapted to co-join the cooperative terminus of cylinder 19*a*, through the bracket in question, to frame member 4*a*, with sufficient degrees of freedom to afford lateral displacement of the teeth in the manner earlier mentioned herein. In like manner, oversize wholes/undersized pins are used intermediate connection points 19*c*, between the respective draught links 23 and corresponding ones of vertical frame members 4*b*. Byu way of example, generally circular bracket holes of about one inch in diameter, are used in conjunction with generally cylindrical pins having an outside diameter of about three quarters of an inch.

The lateral freedom mentioned above can additionally or alternatively be provided by way of clearances in the fitting of teeth 2 on bracket 5. Referring now to FIG. 3 in particular, one form of bracket 5 is illustrated in an exploded perspective that reveals holes 11. These holes 11 are arranged in an array that is adapted to receive respective ones of leading and trailing teeth 2*a* and 2*b*, and so as to provide a range of from about 1/16 to 3/32 of an inch clearance between the edges of holes 11 and the adjacent portions of the teeth shanks 6. A crown 8 provides axial interference means on teeth 2, that limit the axial passage of teeth 2 through corresponding ones of holes 11. Plate 10 is adapted to be received, with teeth 2 positioned in holes 11, in overlaying relation above plate 9. The two plates are bolted together with bolt 10*a* and nut 9*a*, to clampingly engage the axially interfering portions 8 of the teeth, between the two plates.

In one variation a bracket 5*a*, as depicted in FIGS. 3*a* and 3*b*, which includes a lower plate 9*c* constructed out of a pair of channel members 9*d* and 9*e*, which when assembled are mutually fastened together by welds extending along mutual contacting surfaces thereof. More particularly, channel member 9*d* includes holes 11*a* which are adapted to receive adjacent shank portions of corresponding teeth, with about a sixteenth of an inch of play between the edge of the holes, and adjacent surfaces of the shank. Holes 11*b* in channel member 9*e*, on the other hand, provide a corresponding clearance of about 3/32 of an inch. The resulting "constrained pivotal" support of the teeth 2 by bracket 5*a* provides the requisite lateral freedom referred to hereinbefore. Bracket 5*a* also includes and angle member 10*b* which is adapted to be engaged in bolted overlaying relation on plate assembly 9*c*, to thereby trap the axial interfering crowns 8, therebetween, as can perhaps best be seen in FIG. 3*b* of the drawings. Rounded upper surfaces of crowns 8 can advantageously facilitate a rocking motion when fixed in this clamped relation between the two plates.

FIG. 4 of the drawings illustrates the cooperation of the scarifier and blade of the present invention. Note that the operation of cylinders 12*a* and 12*b* provide for height adjusting means, whereby the depth of the scarifier can be varied relative to the blade position. In attachments according to the present invention which are adapted to be secured in combination to other positioning apparatus, and whereby the blade and the scarifier are responsively co-positionable, there is provided the operational advantages already mentioned herein.

Referring now to FIG. 5 of the drawings, there is depicted a conventional three point hitch 18 comprising a centre link 19 connected at one end to a general utility tractor, as viewed from the rear thereof. A rock shaft 21 is hingedly connected to lift links 20, which are hingedly connected at opposite ends thereof, in third class lever relation, to pivoting draft arms 23. Such a three point hitch is advantageously operable in combination with scarifier, and scarifier blade attachments according to the present invention. Further positioning control and operational flexibility can be realized, however, through the use in the abovementioned combinations of a modified three point hitch, such as that illustrated in FIG. 5*a* of the appended drawings.

Referring in that connection to FIG. 5*a*, there is illustrated a modified three point hitch wherein an at least one lift link comprises a selectively operable hydraulic cylinder 20*a* connected to a corresponding at least on draft link 23. Preferably, the modified three point hinge comprises a telescoping interconnecting shaft 24 that extends between the two draft arms 23. Such a shaft, is illustrated in detail in FIG. 5*b*, and includes a first shaft 24*a* that is received in slidable telescoping relation within a second shaft 24*b*. This facilitates adjustment of draft arm spacing, as may be required to facilitate attachment of the present device to a wide range of tractors. In addition, shaft 24 includes a slidably positionable sleeve onto which one end of cylinder 20*a* is secured. This arrangement permits the apparatus to be readily set up so that the radius of hydraulic lift link 20*a* matches the operating radius of the other lift link 20. Once the sleeve is so positioned, it is fixedly secured to the shaft 24, prior to pressing the apparatus into service. In the illustrated combination, centre link 19*a* provides control over the pitch of the attachment, which can be used to co-vary the relative vertical positioning of the scarifier teeth tips relative to the blade tip. Hydraulic lift link 20*a* is operable to vary the side to side pitch of the attachment, which is useful in producing surface contours such as crowns on roadways, or the like.

Referring now to the drawings in general, there is illustrated an attachment in accordance with the present invention, which comprises, in combination, a modified three point hitch, a scarifier and a plough, which is operatively connected to a suitable vehicle, such as the earlier mentioned utility tractor. In operation, the scarifier teeth 2 are positioned relative to the blade tip 15, to result in simultaneous and controlled scarification depth, and loosened aggregate levelling operations. This is facilitated through the selective retraction and extension of cylinders 12*a* and 12*b*.

Side to side pitch of the apparatus is varied through the selective extension and retraction of hydraulic lift link 20*a*, while the height of the apparatus/or the amount of downward pressure exerted through the three point hitch by the tractor, is controlled in conventional manner by the selective positioning of the rock shaft 21. Draft and contour controls of known type, co-operable with the rock shaft positioning, can also be utilized in this combination.

The angle of attack of the working surfaces of the apparatus can be selectively varied through extension and retraction of hydraulic centre link 19*a*.

As the tractor is driven along, the attitude of the apparatus is readily adjustable through the selective operations of the rock shaft 21, the centre link 19*a*, the lift link 20*a*, and the cylinders 12*a* and 12*b*, with the end result that the attachment provides for highly adaptive and versatile surface treatment.

I/We claim:

1. A scarifier comprising:

a plurality of supported, downwardly depending, axially secured, elongated scarifying teeth each having an axially-interfering crown portion at one end thereof, an intermediate shank portion, and a scarifying point at an opposite end thereof; and, a supporting frame having a bracket adapted to engage respective crown portions of said downwardly depending plurality of scarifying teeth in axially secured relation, said shank portions of said scarifying teeth depending through oversized openings, of a first plate of said bracket, said openings having substantially greater dimensions than said shank portion depending therethrough to define a range of lateral freedom for teeth movement and to provide substantial deflectable lateral play at scarifying points of respective ones of said teeth;

whereby said teeth are adapted to be deflectable through a permitted range of substantial lateral motion while being drawn through a gravel substrate during operation of said scarifier, and wherein said bracket further comprising:

a second plate adapted to receive shank portions of said teeth through said corresponding openings which extend through said second plate and are in surrounding relation about said shank, said scarifying point extending below a lower side of said second plate and said crown extending above an opposite upper side of said second plate; and, a third plate adapted to be secured in fixed, spaced apart relation above said upper surface of said second plate with said crown secured between said second and third plates.

2. The scarifier according to claim 1 wherein said scarifying points have hardened tips arranged on said intermediate shank portions which are unhardened.

3. The scarifier according to claim 2 wherein said plurality of teeth are arranged in an array of pairs comprising corresponding leading and trailing teeth.

4. The scarifier according to claim 3 wherein said leading teeth extend to a first operating depth, and said second teeth extend to a second, greater operating depth.

* * * * *